United States Patent [19]

Flechs

[11] Patent Number: 4,461,598

[45] Date of Patent: Jul. 24, 1984

[54] MACHINE FOR INSTALLING DRIP IRRIGATION CONDUIT

[76] Inventor: Ronald D. Flechs, 1042 Samantha Dr., Paso Robles, Calif. 93446

[21] Appl. No.: 346,739

[22] Filed: Feb. 8, 1982

[51] Int. Cl.[3] ..... E02F 5/10; F16L 1/00

[52] U.S. Cl. ..... 405/181; 111/2; 405/36; 405/180; 405/174

[58] Field of Search ..... 405/174, 180, 181, 182, 405/178, 179; 111/2–4; 37/63; 172/40 R

[56] References Cited

U.S. PATENT DOCUMENTS

| | | | |
|---|---|---|---|
| 2,155,044 | 4/1939 | Gray et al. | 405/181 |
| 2,184,912 | 12/1939 | Freeman et al. | 405/181 X |
| 2,909,134 | 10/1959 | Kniefel | 405/181 |
| 3,313,115 | 4/1967 | Kniefel | 405/180 |
| 3,546,887 | 12/1970 | Helmus | 405/180 |
| 3,668,879 | 6/1972 | Ogle | 405/180 |
| 3,813,888 | 6/1974 | Purriance | 405/180 |
| 3,905,200 | 9/1974 | Ylinen | 405/180 X |

*Primary Examiner*—Dennis L. Taylor
*Attorney, Agent, or Firm*—Huebner & Worrel

[57] ABSTRACT

A machine for installing drip irrigation conduit consisting of a horizontally extended hose and upright risers spaced along the hose, the machine being adapted to move along a predetermined track of conduit installation; the machine having a pair of coulters and a moldboard disposed to generate a furrow having a vertical wall and an opposite wall at an acute angle to the vertical; a reel for transporting preprepared conduit which is drawn from the reel by previously buried conduit as the machine moves along the track; a pair of downwardly convergent, planar guards extended along the furrow and individually upwardly along respective walls; a wheel disposed between the guards for rotation in a plane parallel to such opposite wall, the wheel having fingers spaced about it circumferentially and extended toward the guard along the vertical wall; elements for guiding the hose from the reel for engagement by the fingers at the lower sector of the wheel to lay the conduit in the bottom of the furrow; elements for guiding the risers successively to the wheel in radial relation to it so that each riser is brought into an upright disposition as the corresponding portion of the hose is laid; and a crowder disposed to return earth removed by the moldboard to the furrow in a direction toward the vertical wall to urge each riser toward such wall and to maintain the riser in its upright disposition as the furrow is filled by the returned earth.

23 Claims, 23 Drawing Figures

MACHINE FOR INSTALLING DRIP IRRIGATION CONDUIT

BACKGROUND OF THE INVENTION

1. Field of the Invention

The present invention relates to a machine for installing drip irrigation conduit, and more particularly to such a machine for automatically installing pipe prepared conduit consisting of hose to be buried in the earth and a plurality of risers spacing along the hose and extended in an erect disposition upwardly from the hose, the machine being particularly adapted for use in installing large-scale irrigation systems and for installing the conduit beneath and adjacent to existing plants in an orchard or the like.

2. Description of the Prior Art

Drip irrigation, in which water is applied to the earth in a controlled amount adjacent to each plant, provides the maximum utilization of water since little water is lost due to evaporation or due to application where water will run off or otherwise not reach the plant roots. A particularly effective method of drip irrigation, which is effective with new or existing orchards, vineyards and the like, is to bury a hose along a row of plants to be irrigated and beneath the earth surface where the hose is unlikely to be damaged by implements or animals and to provide the hose with risers extended upwardly therefrom to points individually adjacent to the plants and above the earth surface. It is known to facilitate the installation of such conduit by the use of preprepared conduit in which the risers are mounted on the hose for pivotal movement in a plane normal thereto before the conduit is installed.

It is possible to avoid the use of risers extended above the earth surface by utilizing buried emitters spaced along a length of buried pipe or hose. However, such buried emitters are likely to be blocked by the growth of roots from the plants being irrigated and this blockage is difficult to detect or to correct.

It is known to install drip irrigation conduit by laying hose or somewhat flexible pipe in a predetermined route along the earth surface and then, in a subsequent operation, moving an implement along the route to form a furrow of the usual trough-like configuration along the route while the hose or pipe is carried upwardly over the implement and placed in the furrow, the furrow subsequently being backfilled. This method of installing conduit is also usable when the conduit is preprepared with risers, however, it is necessary with such preprepared conduit manually to manipulate the conduit to ensure that the hose or pipe is at the proper depth and that the risers remain erect during backfilling. It is also known to bury such hose or pipe by passing it into a moving cavity being continuously formed and refilled by a blade moving beneath the earth surface, the hose or pipe being passed from above the earth surface through an opening in a shank of the blade into such cavity. Conduit preprepared with risers cannot be used with the latter method since the risers cannot pass through the opening and, in any event, the risers would not necessarily be disposed in an erect disposition when the cavity closes.

In existing methods of installing drip irrigation conduit, a ripper blade is used which extends downwardly to a depth approximately twice the depth of the furrow bottom or cavity formed by the blade. As a result the roots of existing plants, including the larger and deeper roots, are damaged to a depth below that required for actually laying the conduit. Further, existing implements for installing irrigation conduit are disadvantageous for laying drip irrigation conduit in the most desirable position which is a position close to the trunks of existing trees or vines. This is because existing implements for this purpose not only cause extensive root damage, but because they engage and break off and otherwise damage lower branches. Such existing implements are also illsuited to the use of a reel wound with preprepared conduit having a flexible hose. Such use of a reel reduces the required number of operations in installing drip irrigation conduit, but is particularly disadvantageous with existing implements because the reel is disposed above the implement and would damage the higher branches of existing plants as well as their lower branches.

Underground laterals for sprinkler irrigation systems having risers extending from the laterals to above ground spray heads are installed with a device resembling a pair of ripper blades disposed in adjacent spaced relation to define a slot. Polyvinylchloride, "PVC", pipe preprepared with risers is laid along the route as described above and fed into the slot for burial in a furrow formed by the blades as they move through the earth. Fingers fixedly mounted on the blades extend transversely into the slot and maneuver each riser to that it arrives in the furrow in an erect disposition. Such a device, although causing the root damage described in the previous paragraph, is effective with PVC material which is relatively strong and has the risers adhesively connected to the pipe in a manner giving strength equal to that of the material itself. PVC also possesses "memory" so that the risers tend to assume an erect position if preprepared in such a position. However, it is undesirable to use PVC material with drip irrigation systems because of its rigidity and expense compared to polyethylene material which is sufficiently strong to withstand the lower pressures used in drip irrigation. The device just described for use with PVC material is not effective with polyethylene because the weaker material itself cannot withstand the stretching as the hose is drawn over the fingers and the impact of the fingers on the hose and risers. In any event, such stretching pulls apart the connections between polyethylene hoses and risers which are friction tight and thus easily and economically formed. Even if preprepared, drip irrigation conduit of polyethylene material cannot withstand the stresses inherent in such a device, this material lacks "memory" and the risers would not assume the required erect disposition.

The prior art is replete with agricultural implements for generating a furrow in the earth surface, and it is known to precede a conventional moldboard plow with a planar, discoidal coulter having a substantially horizontal axis extended transversely of the direction of movement of the implement in generating a furrow. However, insofar as known to the applicant, it is not known to use such a coulter and plow with a second such coulter having its axis inclined to the horizontal so that the two coulters and plow generate a furrow having a substantially upright wall and an opposite wall extended in upwardly diverging relation to the upright wall at an acute angle to the vertical.

Despite the deficiencies of existing implements for installing drip irrigation conduit, which deficiencies include multiplicity of operations, excessive manual manipulations, and damage to plants, the advantages of drip irrigation at a time when the need to conserve water is imperative are such that thousands of acres are being provided with such conduit. It is apparent, therefore, that a machine which installs preprepared drip irrigation conduit having erect risers in one operation and which substantially avoids damage to existing plants is highly advantageous, provides substantial reduction in cost, and allows the water savings of drip irrigation systems to be further extended.

PRIOR ART STATEMENT

In conformance with 37 C.F.R. § 1.97 and § 1.98, the applicant states that he is not aware of any prior art other than that discussed above which is relevant to the patentability of the subject invention.

SUMMARY OF THE INVENTION

It is an object of the present invention to provide an improved machine for installing drip irrigation conduit.

Another object is to provide such a machine which automatically installs in the earth surface drip irrigation conduit having a buried hose and a plurality of upright risers spaced along the hose and extended upwardly therefrom to above the earth surface.

Another object is to provide such a machine which installs such conduit, which is preprepared, along a desired route in a single pass of the machine along the route.

Another object is to provide such a machine wherein the risers are installed in a precisely upright position.

Another object is to provide such a machine which does not injure the conduit as it is installed.

Another object is to provide such a machine which effectively installs drip irrigation conduit constructed of polyethylene material, including such conduit having elements retained in connected relation by friction.

Still another object is to provide such a machine which installs drip irrigation conduit with minimal damage to the roots and branches of existing plants when the conduit is installed along and in closely adjacent relation to a row of trunks thereof.

Yet another object is to provide such a machine adapted to install such conduit beneath the branches of existing trees in an orchard.

These and other objects and advantages are obtained through the use of a machine for installing drip irrigation conduit which is characterized by having a reel transporting such prepared conduit, elements which form a furrow having a vertical wall, a wheel having fingers which carry hose of the conduit into a position along the bottom of the furrow and bring the risers into an upright disposition along this wall, and a crowder for backfilling the furrow in a direction toward this wall so that the risers are maintained in such a disposition.

DESCRIPTION OF THE PREFERRED EMBODIMENT

Figure 1:
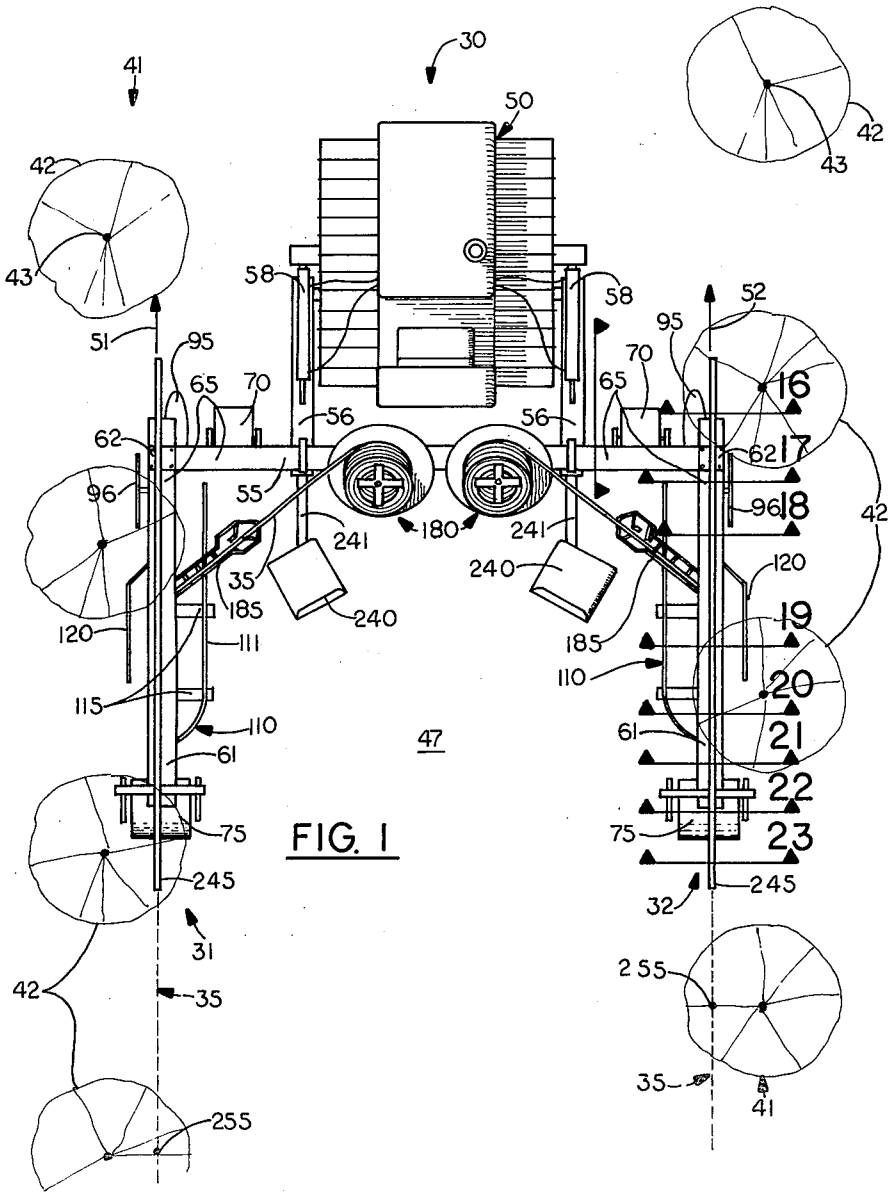
FIG. 1 is a top plan view of a pair of machines, which embody the principles of the present invention and are for installing drip irrigation conduit, the machines being depicted in a representative operating environment which is somewhat schematically represented and includes a tractor and rows of trees.
Figure 4:
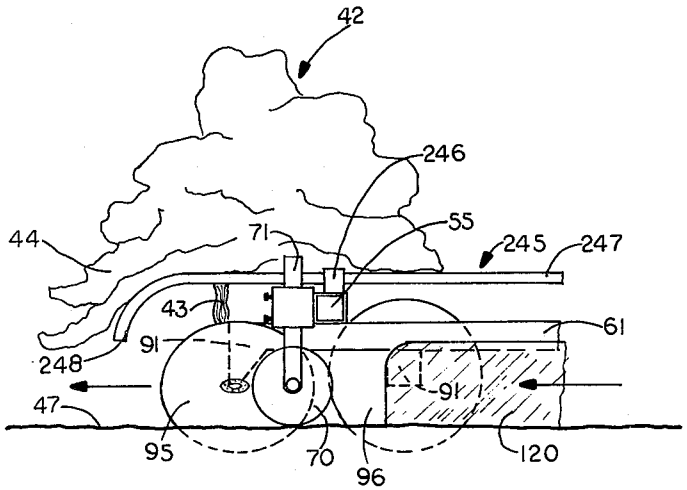
FIG. 4 is a fragmentary view of the other machine and of the operating environment taken from the position of line 4—4 of FIG. 1.
Figure 2:
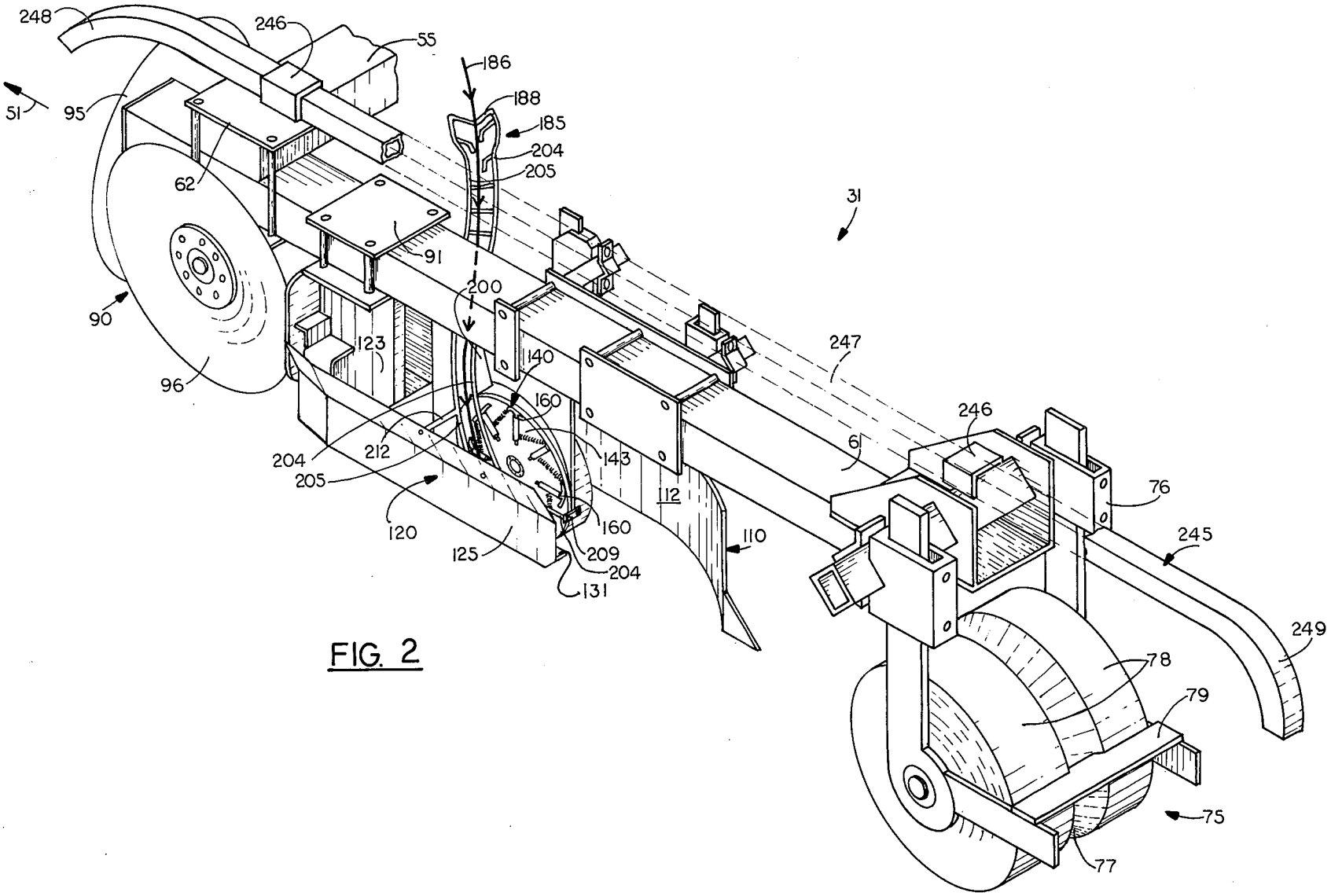
FIG. 2 is a perspective view at an enlarged scale of one of the machines of FIG. 1 with portions of the machine represented fragmentarily and in dash lines for illustrative convenience.
Figure 3:
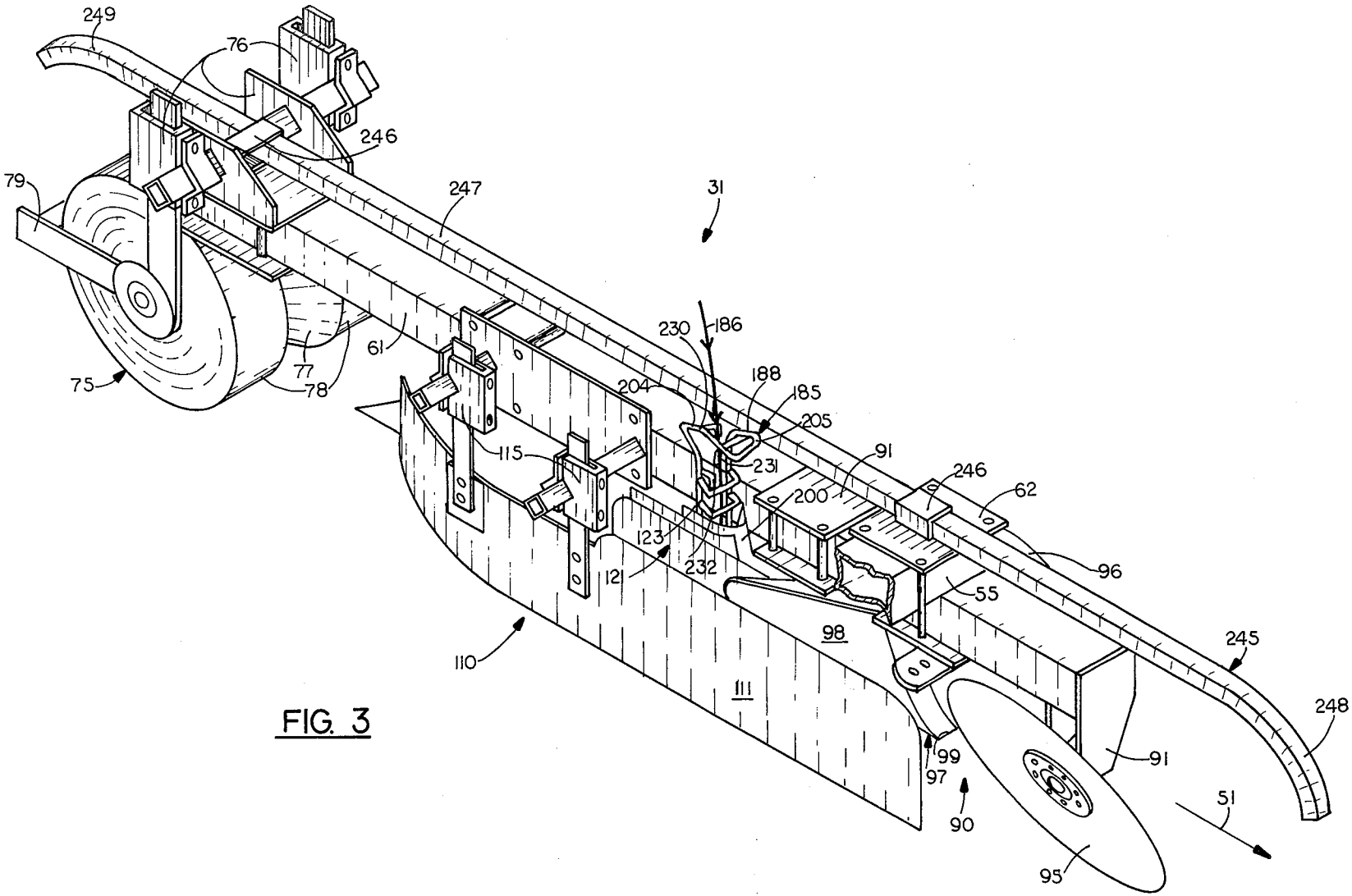
FIG. 3 is a perspective view of the machine from a position generally opposite the position of FIG. 2.

Referring with greater particularity to the drawings, in FIG. 1 is shown an apparatus, indicated generally by the numeral 30, which includes a pair of machines 31 and 32, each of which is for installing a drip irrigation conduit 35 and embodies the principles of the present invention. The machine 31 is depicted as being toward the left hand side of FIG. 1 and portions of this machine are shown in FIGS. 2, 3, and 4. As is apparent from FIG. 1, the machine 32 is a "mirror image" of the machine 31 so that the apparatus is adapted to operate between two rows 41 of trees 42 which are schematically represented in FIG. 1 and have trunks 43 and lower branches 44, as shown in FIG. 4. The trees are depicted as existing trees in an orchard or the like having an earth surface 47, best shown in FIGS. 1 and 4. However, it is to be understood that a machine embodying the principles of the subject invention and similar to the machines 31 and 32, may be used with other kinds of existing plants or used to install drip irrigation conduits in virgin ground, and that one such machine is usable by itself or that a greater number than two of the machines may be operated together concurrently to install a corresponding number of conduits.

The apparatus 30 includes a tractor 50 of any suitable type for motivating the machines 31 and 32 in a predetermined direction along respective and predetermined routes 51 and 52, the conduits being installed by the machines in individually adjacent relation to the trunks 43 in the rows 41. The conduits and the routes are disposed at the facing sides of adjacent rows and the tractor is disposed centrally therebetween. Each of the machines is thus disposed adjacent to the trunks of the corresponding row with the trunks disposed at one side of the corresponding route. It is apparent that the lower branches 44 of each row extend transversely across the corresponding route as best shown in FIG. 1. The apparatus has a tool bar 55 of any suitable construction disposed rearwardly of the tractor and extended between and transversely of the routes with the opposite ends of the bar being individually adjacent to the rows of trees. The tool bar is connected to the tractor for motivation thereby by a pair of generally horizontal arms 56 having forward ends pivotally mounted onto the tractor and rearward ends secured to the tool bar. Each arm is pivoted with an extensible and contractible hydraulic ram assembly 58 of well known construction and disposition which extends upwardly from the arm to a point on the tractor. Each of the machines has a longitudinal bar 61, shown in FIGS. 1 through 4, which extends a relatively short distance forwardly of the tool bar and extends rearwardly thereof for a substantially greater distance. Each longitudinal bar extends along the corresponding route at a substantial height above the earth surface 47, and is fixedly connected to the tool bar by a releasable clamp 62 of any suitable construction. The longitudinal bar of each machine and the corresponding outer one half of the tool bar defined a frame 65 of the machine on which elements subsequently to be described are mounted for motivation by the tractor along the corresponding route.

Each of the machines 31 and 32 has a cylindrical, roller-like forward gauge wheel 70 mounted by any suitable mount 71 on the corresponding frame 65 for movement therewith. The wheel and mount are of conventional construction and the mount is adapted for adjustment of the elevational position of the wheel relative to the frame and releasably to clamp the wheel in a desired such position. Each wheel is disposed forwardly of the tool bar 55 between the longitudinal bar 61 of the corresponding machine and the adjacent one of the arms 56. Each machine has a rearward gauge wheel or roller 75 mounted on its frame for movement therewith by any suitable mount 76. This mount provides for elevational adjustment of the rearward wheel relative to the frame in a manner similar to that provided by the mount at the forward wheel. The rearward wheel has an axially central annular groove 77 and a pair of cylindrical end portions 78 disposed axially oppositely thereof. The groove has a predetermined radial depth and the sides of the groove converge toward the axis of the wheel. The rearward wheel is, preferably, provided with a scraper 79 for removing earth adhering to its end portions. The axes of both gauge wheels extend substantially horizontally and transversely of the direction of movement of the machines along their respective routes 51 and 52. It is apparent that the wheels are adapted to support the frames 65 for movement along the routes at a predetermined distance above the earth surface 47 and that this distance is adjustable by the mounts 71 and 76. Each rearward wheel is disposed so that its groove is aligned with the corresponding route.

Each machine 31 or 32 has furrowing elements, which are indicated generally by the numeral 90 and are individually mounted on the longitudinal bar 61 toward the tool bar 55 for movement therewith at respective predetermined distances therebelow by any suitable brackets 91. These elements, individually, are of previously known construction. These elements are, in a direction along the longitudinal bar opposite to the direction of movement along the corresponding route 51 or 52, a first or inclined coulter 95, a second or vertical coulter 96, and a plow 97 having a moldboard 98 and a lower leading edge 99. Each coulter is a substantially planar discoidal blade having a circular periphery adapted for cutting through the earth. The first coulter is mounted on the frame for rotation about a central axis extended transversely of such direction and at an acute angle to the horizontal and thus generally horizontally, while the second coulter is mounted on the frame for rotation about a central axis which is substantially horizontal and extends transversely of such direction. The lower edges of the coulters are disposed substantially at the same elevation and the lower edge of the second blade is spaced somewhat transversely of such direction from the lower edge of the first coulter in a direction away from the tractor 50, that is in a direction toward the row 41 adjacent to the corresponding machine. The upper surface of the inclined first coulter extends from its lower edge upwardly and transversely of this row. The lower leading edge of the plow is disposed substantially at the same elevation as the edges of the coulters and is aligned therebetween in a direction along the corresponding route. The moldboard extends from the side of this route in a direction oppositely of the row and upwardly of the leading edge.

Each machine 31 or 32 has a backfilling element or crowder 110 disposed generally downwardly of its longitudinal bar 61. The crowder has an upright planar plate 111 disposed at the side of this bar toward which the moldboard 98 extends from the leading edge 99 thereof. As best seen from FIGS. 1 and 3, this plate extends along the corresponding route 51 or 52 from a point transversely adjacent to the inclined coulter 95 alongside this edge to a point spaced substantially rearwardly of the moldboard. The crowder has a curved plate which is a unitary extension of the planar plate rearwardly of the latter point. The curved plate is erect and curves in a horizontal plane from the planar plate beneath the longitudinal bar so as to present a surface 112 which extends angularly across such route from the planar plate forwardly of the roller 75. Each crowder is mounted on the corresponding longitudinal bar for movement therewith by a pair of brackets 115, best shown in FIG. 3, which extend from the bar to the planar plate of the crowder. The brackets provide for adjustment of the position of the crowder transversely of the routes and vertically in relation to the corresponding frame 65 and provide for releasably clamping the crowder in a selected such position. These brackets are of a construction well known in agricultural implements. It is apparent that the roller 75 and its axis of rotation are disposed from the surface 112 in a direction opposite the direction of movement of the machines along the routes 51 and 52 and are thus disposed rearwardly of this surface.

Figure 6:
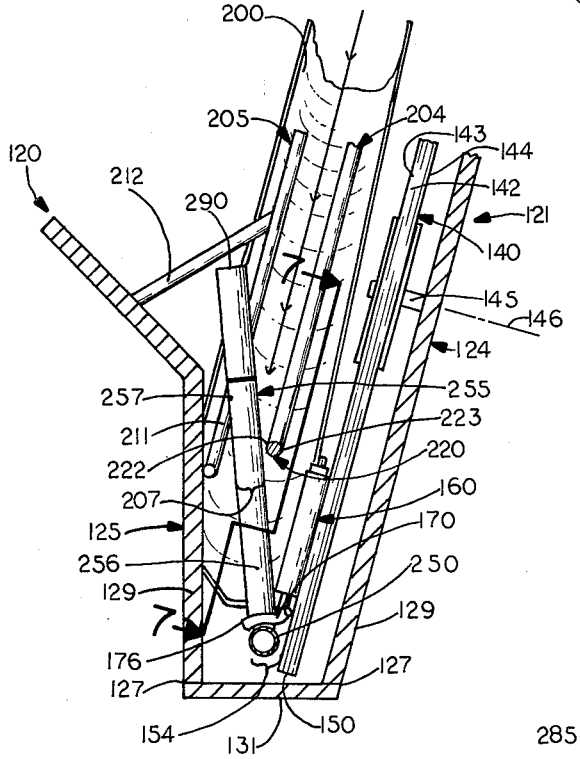
FIG. 6 is a vertical elevation at a further enlarged scale of the wheel and associated elements and a portion of the conduit taken from the position of line 6—6 of FIG. 5.

Each of the machines 31 and 32 has a pair of generally planar guards 120 and 121 fixedly mounted on its longitudinal bar 61 for movement therewith by brackets 123 of any suitable construction. The guards are best shown in FIGS. 2, 3, and 6. The guards are disposed along the corresponding longitudinal bar at a position between the plow 97 and the surface 112 of the crowder. One of the guards, the guard 120, is generally upright and the other of the guards, the guard 121, extends generally parallel to the inclined coulter 95. The guards are thus disposed in downwardly convergent relation. The guards are, in general, coextensive in a direction along the routes 51 and 52. The guards are spaced transversely of the routes, the one guard being disposed in a direction away from the tractor 50, which is the direction toward the corresponding one of the rows 41, from the other of the guards. As best shown in FIG. 6, the guards have a first planar plate 124 which is the lower portion of such other of the guards and is substantially parallel to the plane of the inclined coulter, and have a second planar plate 125 which is substantially parallel to the plane of the vertical coulter 96 and thus has an erect disposition. The plates have individual lower edges 127 which are substantially linear, parallel, and horizontal and are disposed at a somewhat higher elevation than the lower edges of the coulters. The plates extend in a direction along the routes, and the lower edges of the plates are spaced transversely of this direction a distance somewhat less than the corresponding distance between the lower edges of the coulters. The lower edges of the plates are generally aligned in such direction with the corresponding coulter. For reasons which will be apparent, the guards are rigidly constructed, typically of steel, and the outer face of the plates preferably is "hard surfaced" on the area identified by the numeral 129. Each machine has a substantially horizontal and rectangular planar member or bottom plate 131, shown in FIGS. 2, 6, 18, and 19, extending between these lower edges and extended forwardly therefrom to the leading edge 99 of the moldboard 98. Preferably, the bottom plate is fixedly connected, as by welding, with the leading edge and the lower edges and thus interconnects the guards 120 and 121.

Each of the machines 31 and 32 has a finger wheel, indicated generally by the numeral 140 and best shown in FIG. 2 and in FIGS. 5 through 8. The wheel is mounted on the first plate 124 for movement therewith along the corresponding route 51 or 52. The wheel is thus disposed rearwardly of the frame 65 from the furrowing elements 90. The wheel is generally planar, having a planar disc 142 which is disposed in parallel adjacent relation to the first plate. The disc has one side 143, which is disposed oppositely of this plate and toward the guard 120, and an opposite side 144. The disc 142 is rotationally mounted on the first plate by a pivot assembly 145 of any suitable construction providing substantially free rotation of the wheel about a central axis 146, shown in FIGS. 6 and 7. This axis extends transversely of the routes and is normal to the first plate, so that the wheel rotates in a plane substantially parallel to the plane of the inclined coulter 95. Since this plane is at an acute angle to the vertical, this axis may be described as being generally horizontal.

The one side 143 of the disc 142 has a periphery 150. At any position of rotation of the wheel 140 about the axis 146 this periphery presents a lower sector 152 disposed toward and in upwardly adjacent relation to the lower edges 127 of the first plate 124 and the second plate 125. This sector is spaced from the lower edge of the second plate in a direction transversely of the routes 51 and 52 a distance greater than a first predetermined distance, which is determined as subsequently will be described and is indicated by the numeral 154 in FIG. 6. As the wheel rotates in a direction such that this sector moves in a direction opposite of the predetermined direction of movement along the routes 51 and 52, the portion of the one side spaced radially inwardly of the periphery a distance approximately equal to such predetermined distance moves in an orbital path, which is indicated by the arrows 156 and is about the axis 146. This path is planar and has a lower portion 157 which corresponds to such sector and moves in the direction just described. Conversely, the sector can be described as moving along this portion of the path. The plane of the path extends, of course, upwardly from its lower portion.

The wheel 140 has a plurality of finger assemblies 160, best shown in FIGS. 5 through 8, mounted on the one side 143 of the disc 142 in substantially equal angularly spaced relation thereabout for rotation with the wheel. Radially of the wheel, the assemblies are disposed centrally of the path 156 and adjacent thereto. It is apparent that the assemblies are spaced along this path circumferentially of the wheel and its one side and are spaced radially inwardly of the periphery 150 a distance generally equal to the predetermined distance 154. Each assembly includes a cylindrical sleeve 162 fixedly mounted on the one side with the axis of the sleeve parallel to a radius of the wheel. Each sleeve is provided with an eye 163. The eye is mounted on the sleeve at a point disposed toward the center of the wheel and toward the adjacent finger assembly in a direction opposite to the direction of the path 156. Each assembly has a shaft 165 extended through the sleeve and pivotally fitted therein. The shaft extends axially in opposite directions from the sleeve, the end of the shaft toward the center of the wheel being provided with screw threads. This end, typically, is fitted with a pair of nuts 167. These nuts secure the shaft, together with elements fixed to its opposite end and next to be described, to the sleeve.

Figure 8:
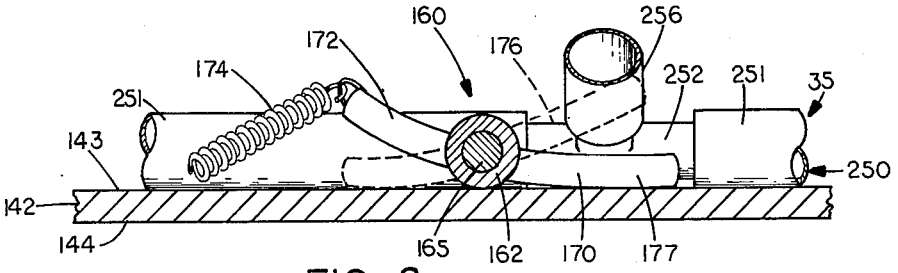
FIG. 8 is a fragmentary view taken from the position of line 8—8 depicting a finger of the wheel and a portion of the conduit engaging the finger, an alternate position of the finger being represented in dash lines.
Figure 7:
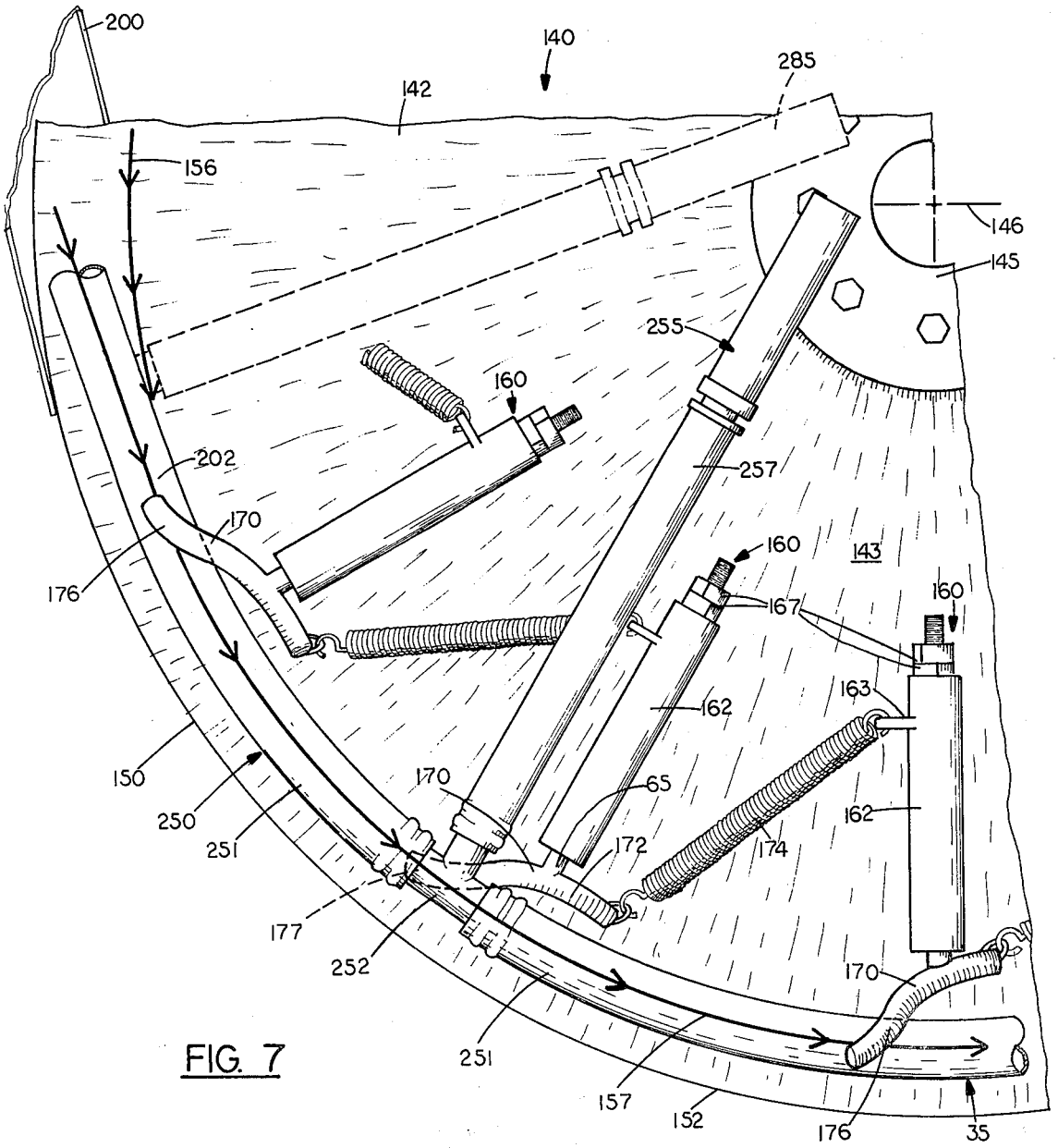
FIG. 7 is a fragmentary view of the wheel and a portion of the conduit at a still further enlarged scale taken from the position of line 7—7 of FIG. 6.

Each assembly 160 has an elongated finger 170 fixedly mounted on the end of the shaft 165 opposite to the end having the nuts 167. The finger extends from the shaft generally across the path 156 and in a direction opposite thereto for a distance substantially greater than the predetermined distance 154. The finger is thus pivotally mounted in the wheel by the shaft and the sleeve 162 for movement toward and from the one side 143 of the wheel. The finger is of circular cross section and is curved so as to be concave in a direction toward the one side. Each finger assembly has an arm 172 fixedly mounted on its shaft and extended radially therefrom in a direction opposite its finger. The arm terminates in an eye, and this eye and the adjacent eye 163 are interconnected by a tension spring 174. The dimensions and proportions of the finger and arm are such that, as best shown in FIGS. 7 and 8, the spring resiliently urges the finger and the arm to pivot into a first position 176 depicted in dash lines in FIG. 8. In this position, the arm engages the one side of the wheel and the finger is extended from this side. It is evident that, with the finger in the first position, engagement of the finger by an object at its side away from the one side of the wheel urges the finger toward the one side against the urging of the spring and into engagement with the one side of the wheel, the finger and arm then being in a second position 177. It is evident that the finger extends along this one side and axially therefrom in the first position, and that the spring resiliently urges the finger from the one side.

Figures 9, 10, 11, 12, 13, 14, 15:
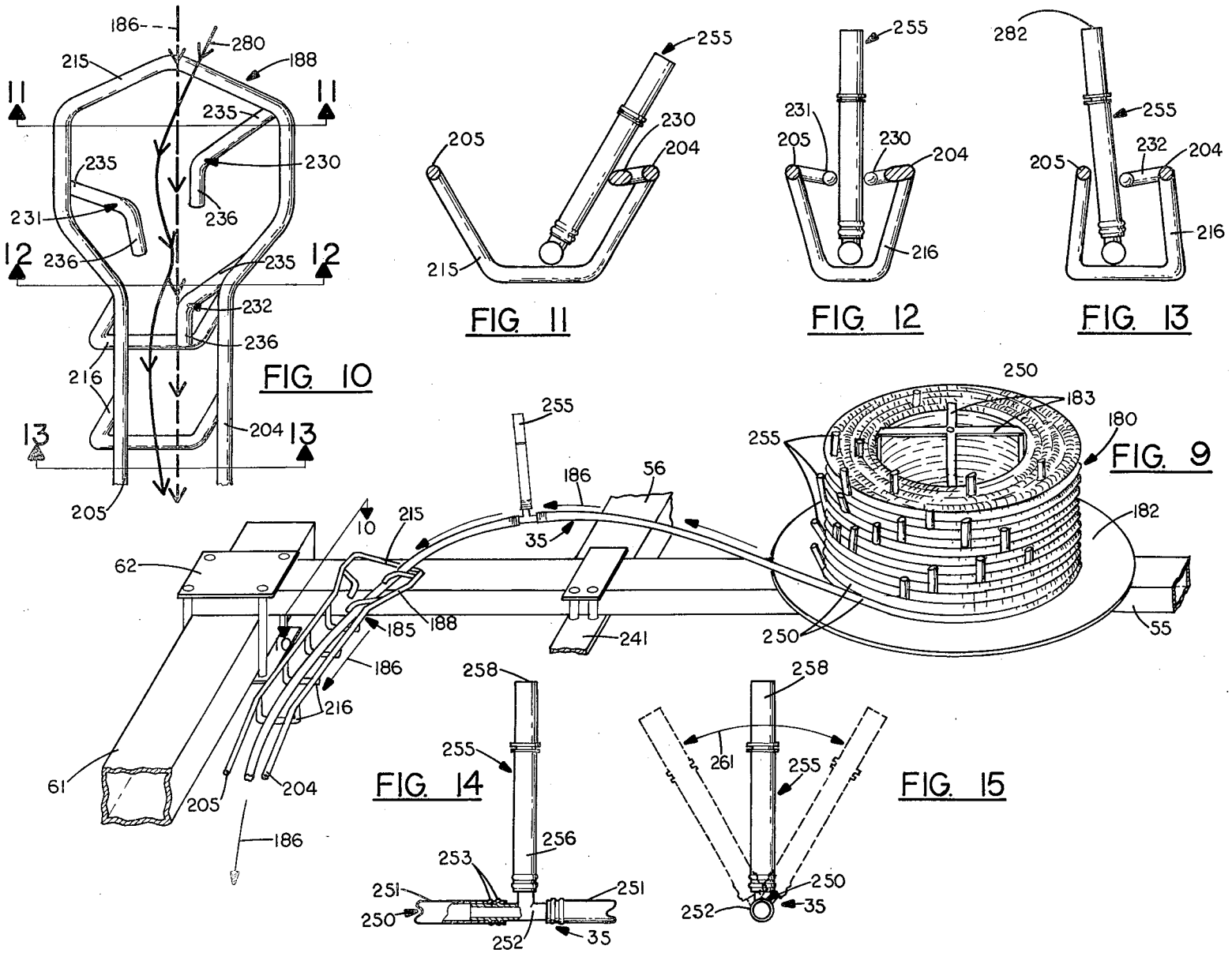
FIG. 9 is a fragmentary perspective view of the machine at a scale enlarged from that of FIG. 1 depicting a reel with conduit would thereon and related elements.
FIG. 10 is a fragmentary view of conduit guiding elements of the machine and conduit taken from the position of line 10—10 of FIG. 9 at an enlarged scale.
FIGS. 11 through 13 are sectional views taken, respectively, from the positions of lines 11—11, 12—12, and 13—13 of FIG. 10 and showing successive positions of a riser of the conduit as it moves through the conduit guiding elements.
FIG. 14 is a fragmentary, side elevation of an irrigation conduit illustrative of conduits which the machine of the present invention is adapted to install.
FIG. 15 is an end view of the conduit of FIG. 14 illustrative of the pivotal adjustment of a riser thereon.

Each machine 31 and 32 has a reel 180, best shown in FIGS. 1 and 9. The reel serves to transport with the machine a length of conduit 35 to be installed by the machine and to supply this conduit to the balance of the machine. The reel is disposed rearwardly of the tractor 50 and is mounted on the frame 65 of the machine on the portion of the tool bar 55 corresponding thereto. The reel is mounted on the bar in any suitable manner for rotation about a predetermined axis. This axis lies in a vertical plane which extends upwardly from the bar, the axis being inclined somewhat rearwardly thereof for a reason subsequently to be described. The reel has a disc-like floor 182 adjacent to the tool bar and has a central cylindrical cage 183. The cage is of substantially smaller diameter than the floor and extends upwardly from the floor in concentric relation with it. It is apparent from FIG. 1 that each reel is disposed transversely of the corresponding route 51 or 52 and is disposed oppositely of the trunks 43 of the trees 42 in the adjacent row 41 so that the reel does not engage the trees.

Each machine 31 and 32 has a conduit guide 185, shown in FIGS. 1, 2, 3, 5, and 6 and in FIGS. 9 through 13, for guiding conduit 35 along a predetermined course, which is represented by arrows 186, from the reel 180 of the machine to the orbital paths 156 of its wheel 140. The conduit guide has an entrance 188 directed toward the reel and tangentially of the cage 183 thereof. The axis of the reel is inclined, as before stated, to facilitate this relative disposition of the entrance and reel. Each conduit guide includes several elements which are individually and fixedly mounted on the corresponding frame 65 for movement therewith. The course is sinuous since a more direct course from the reel to the orbital path would intersect the longitudinal bar 61 and the guard 121 as best seen in FIG. 3.

Figure 5:
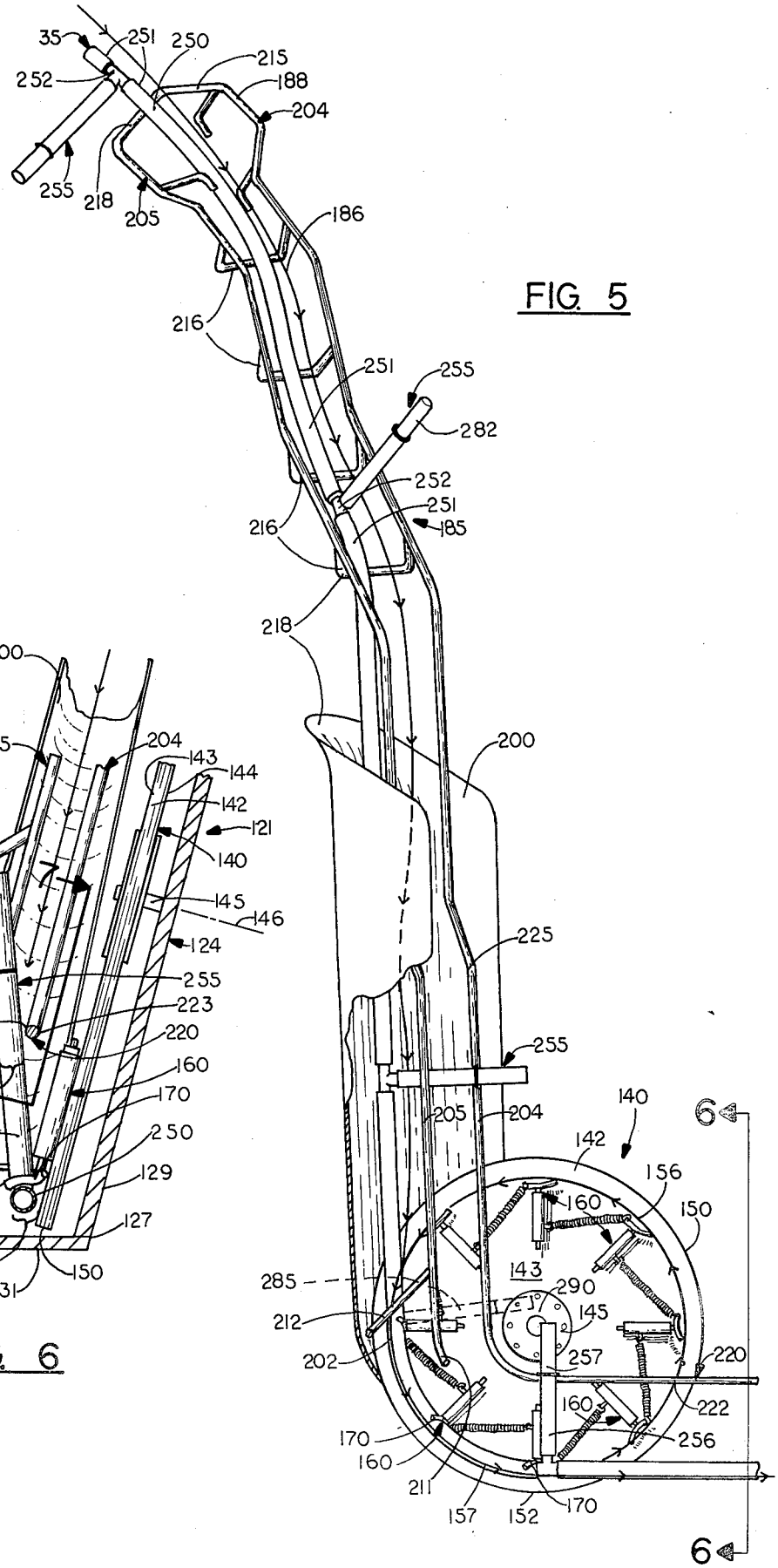
FIG. 5 is a perspective view of a finger wheel of the machine of FIG. 1 and an associated conduit guiding elements together with a portion of a drip irrigation conduit, at a scale enlarged from that of FIGS. 2 and 3.

Each conduit guide 185 includes an elongated, sinuous trough 200 shown in FIGS. 2, 3, 5, 6 and 7. The trough extends generally along the corresponding course 186 from a point alongside the corresponding longitudinal bar 61 and extends forwardly and upwardly of the wheel 140, as seen in FIG. 3, to a point which is indicated by the numeral 202 in FIGS. 5 and 6 and is on the orbital path 156. This point is disposed upwardly and in the direction of movement along the corresponding routes 51 or 52 from the sector 152 of the periphery 150 of the disc 142. The end of the trough adjacent to the wheel 140 merges with the guard 121 and the trough is open upwardly and toward the wheel. Each conduit guide includes a first riser guide rail 204 and a second riser guide rail 205, best shown in FIGS. 2, 5, and 6 and in FIGS. 10 through 13. These rails are of circular cross section, as best seen in FIG. 11, and extend along the corresponding course 186 from the entrance 188 to the vicinity of the wheel. The rails are spaced apart transversely of the course. Except toward the entrance, the rails are substantially parallel and are spaced, as best shown in FIGS. 6 and 13, a distance somewhat greater than a second predetermined distance, this distance being determined as subsequently will be described and indicated by the numeral 207 in FIG. 6. Toward the entrance the rails diverge as best shown in FIGS. 5 and 10. It is thus apparent that the rails converge, in a direction which is along the surface from the reel 180 toward the point 202, to a distance apart somewhat greater than such second predetermined distance. In relation to the second rail and as best evnisioned from FIGS. 1, 2, and 9, the first rail is disposed toward the one of the tree rows 41 which is adjacent to the corresponding machine 31 or 32.

The first rail 204 extends from the entrance 188 past the wheel 140 and terminates in the vicinity thereof at a bracket 209 which is shown in FIG. 2 and is mounted on the guard 121. The second rail 205 extends from the entrance and terminates at an end 211 which is disposed in the vicinity of the sector 152, as shown in FIGS. 5 and 6. This end is supported from the guard 120 by a brace 212 which is shown in FIG. 6 and is fragmentarily represented in FIG. 5. The ends of the rails 204 and 205 at the entrance 188 are joined by a section 215 of rail, best shown in FIGS. 10 and 11, which is generally V-shaped in a plane normal to the course 186. This section is a return bend connecting such ends of the first and second rails and is constructed of similar material to the rails. The conduit guide 185 also has a plurality of generally V-shaped section 216, of such material. These later sections have opposite ends which, individually, are fixedly connected to the first and second rails, as by welding. As best shown in FIG. 5, the sections 215 and 216 extend from the rails in a direction which is downward and away from the wheel 140. These sections define, together with the trough 200, a hose guide 218 which extends along the course 186 between the reel 180 and the point 202 on the orbital path 156 and is spaced transversely of the course from the rails. It is evident that, at the entrance 188, the hose guide extends toward and tangentially of the reel.

The structure of each conduit guide 185 having been generally described, additional structure of each guide and the relations of certain elements thereof to other elements of the corresponding machine 31 or 32 will now be described. As best shown in FIGS. 5 and 6, the first guide rail 204 itself includes a first portion 220 which is disposed adjacent to the wheel 140 between the one side 143 of the wheel and the one guard 120. This first portion thus defines a first riser guide which extends parallel to the predetermined direction of movement along the routes 51 and 52 and is generally parallel to the one side of the wheel. This riser guide is disposed above the lower portion 157 of the orbital path 156 and the corresponding sector 152, and the second plate 125 is disposed oppositely of this riser guide from the wheel. This first portion of the first rail is spaced horizontally away from the one side of the wheel and the orbital path 156 in a direction toward the one guard 120. This portion thus has one side or surface 222 disposed toward the one guard and has an opposite side or other surface 223 disposed toward the wheel. The first portion is disposed so that its one surface is spaced from the one guard a distance greater than the second predetermined distance 207. This other surface is spaced a distance from the one side of the wheel such that the fingers 170 pass therebetween without engaging such other surface as the wheel rotates with the fingers in their respective first positions 176. The first riser guide rail 204 includes a second portion 225 which extends from its first portion 220 along the course 186 and along the second guide rail 205 toward the reel 180 and thus defines a second riser guide extended between such first portion and the reel along the hose guide 218. It is evident that the above defined first riser guide and the second riser guide extend toward and generally tangentially of the reel to receive conduit 35 therefrom. It is also evident that, as previously described, the second portion and the second guide rail diverge in a direction along the course toward the reel and converge in the opposite direction to a distance apart somewhat greater than the second predetermined distance 207.

At the entrance 188 of each conduit guide 185 and as best shown in FIG. 3 and in FIGS. 10 through 13, the second portion 225 of the first riser guide rail 204 has a first projection 230; the second riser guide rail 205 has a second projection 231; and the second portion of the first rail has a third projection 232. These projections are spaced sequentially along the course 186 and are of elongated, finger-like, and rigid construction. Each projection has a proximal portion 235 and a distal portion 236. The proximal portion is fixedly mounted on the part of the corresponding riser guide rail which is adjacent to the return bend section 215. Each proximal portion extends from the corresponding one of such rail parts in converging relation to the other of such parts in a direction away from the reel 180 and toward the orbital path 156. The distal portion of each projection continues from the proximal portion generally in such direction and is spaced from such other rail part a distance somewhat greater than the second predetermined distance 207.

As shown in FIG. 1, each machine 31 or 32 has an operator's seat 240. The seat is disposed between the reel 180 of the machine and the associated entrance 188 and alongside the corresponding course 186. The seat is disposed rearwardly of the course and is mounted on the tool bar 55 for movement with it by a bracket 241 of any suitable construction.

Each of the machines 31 and 32 has a branch lifter 245, shown in FIGS. 1 through 4, which is an elongated bar fixedly mounted on and upwardly of the longitudinal bar 61 of the corresponding frame 65 by any suitable supports 246. The lifter has a central horizontal portion 247 which extends above and along the longitudinal bar and is substantially coextensive with it. The lifter has a forward portion 248 and a rearward portion 249 which extend oppositely from the central portion, respectively, before the first coulter 95 and behind the roller 75. Each of these portions curves downwardly from the central portion toward the earth surface 47 to a point lower than the lower branches 44. It is evident that, as the machines move along their respective routes 51 and 52, the forward portions of their lifters engage any such branches and urge them upwardly to the central portion so that the branches are held thereby from engagement with and possible damage by the balance of the machine as it installs the conduit 35.

Each machine 31 or 32 embodying the principles of the subject invention is usable to install a drip irrigation conduit 35 having a variety of structures. However, the machines are most advantageous when the conduit has a well-known structure, best seen in FIGS. 1, 5, 7, 8, 14 and 15. The conduit is preprepared prior to being wound on the reels 180, typically at a location remote from a location on the earth surface 47 in which the conduit is to be installed. The conduit is a continuous flexible hose 250 constructed of a plurality of lengths 251 of flexible tubing alternating with tee fittings 252, best shown in FIG. 14 and having a pair of aligned arms and a central arm. Each arm of the fitting is provided with a pair of annular, axially spaced ridges 253. As best shown in FIG. 14, each arm of the aligned pair has a corresponding end of one of the lengths connected thereto by being fitted over the ridges in pivotal and fluid-tight relation to the fitting. Each arm and the corresponding length are retained in such connected relation only by friction therebetween. The diameter or thickness of the tubing is substantially equal to the first predetermined distance 154 shown in FIG. 6. The dimensions of the lengths of tubing are such that the fittings are spaced along the hose a distance apart substantially equal to the spacing of the tree trunks 43 along the rows 41.

Figure 22:
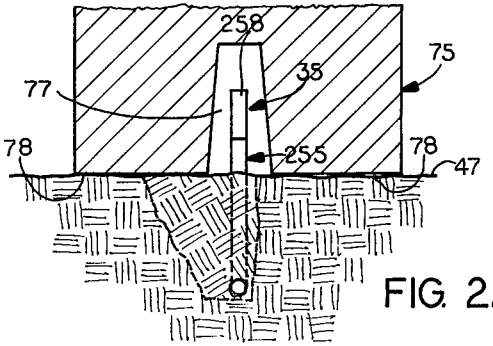

The conduit 35 has a plurality of substantially identical risers 255 individually related to the fittings and, therefore, correspondingly spaced along the hose 250. Each riser is tubular and has a diameter or thickness substantially equal to the second predetermined distance 207. Each riser has a proximal portion 256 fitted to the central arm of the corresponding fitting 252 in the same manner as the lengths 251 are fitted to the aligned arms of the fittings. Each riser thus extends from the hose in a direction substantially normal to the aligned arms of the corresponding fitting and extends transversely from the hose at one side thereof. Each riser has a distal portion 257 spaced from the hose and terminating in an emitter 258. Since the aligned arms of the fitting are pivotally fitted to the corresponding lengths of tubing, it is evident that each riser is mounted on the hose for pivotal movement in a plane normal thereto by pivoting the riser and its associated fitting in the pair of lengths fitted thereto. Therefore, the angular position of the riser about the hose can be varied, as through an angle shown in FIG. 15 and indicated by the numeral 261. The riser has a predetermined length, indicated by the numeral 262 in FIG. 23, such that when one of the conduits 35 is installed in the earth surface 47, as subsequently to be described, by a machine 31 or 32 with the hose buried and extended generally horizontally beneath the earth surface at a predetermined depth along the corresponding route 51 or 52, the riser extends upwardly from the hose in an upright or erect disposition so that the riser extends above the earth surface to a predetermined height, indicated by the numeral 263 in FIG. 33. This height is less than the radial depth of the groove 77 of the roller 75, as shown in FIG. 22.

OPERATION

The operation of the described embodiment of the subject invention is believed clearly apparent and is briefly summarized at this point. The apparatus 30 is transported, using its tractor 50, to an orchard or the like having the surface 47 in which the conduits 35 are to be installed along the rows 41 of trees 42. When the apparatus is being so transported, and at other times when it is being moved or maneuvered and conduit is not being installed, the machines 31 and 32 are lifted from engagement with the earth surface by contracting the ram assemblies 58. Prior to installing conduit, the spacing of the machines 31 and 32 transversely of their respective routes 51 is adjusted, if required, utilizing the clamps 62 in a well-known manner to position the machines along the tool bar 55 so that the conduits will be installed at the desired spacing from the trees. The vertical relation of each of the gauge wheels 70 and 75 to its respective frame 65 is adjusted, utilizing the mounts 71 and 76, so that when these wheels engage the earth surface, the conduit will be installed therein with the emitter extended to the predetermined height 263. Each crowder 110 is adjusted elevationally in relation to the corresponding frame 65 by its respective brackets 115 so that the plate 111 is disposed in closely adjacent relation to the earth surface 47. These brackets are also utilized to adjust the crowder transversely of the routes 51 and 52 in relation to the frame for a reason subsequently to be described.

The reel 180 of each machine 31 or 32 is then provided in any suitable manner with a supply of the preprepared conduit 35 wound about the cage 183 upwardly of the floor 182, as best shown in FIG. 9. The conduit is disposed in wound-about relation to the cage in a plurality of layers with each riser 255 extended in generally parallel relation to the axis of the reel, the risers of the inner layers being maintained in such relation by the hose 250 of layers disposed outwardly of and about such risers. A portion of the conduit is then drawn manually from the reel and through the machine, as may be visualized from FIGS. 2, 5 and 9, along the course 186 and from the point 202 along the portion of the orbital path 156 at the sector 152. At this sector, the hose is drawn between the fingers 170 thereat and the one side 143 of the wheel, the fingers being in their first positions 176. The conduit is next drawn horizontally and rearwardly of the sector through the groove 77 of the rearward gauge wheel 75, and a suitable length of the hose buried in the earth surface 47 in any suitable manner, as in a manually generated furrow not shown, to anchor the conduit. It is evident that, with the hose so anchored, movement of the machines in the predetermined direction along their routes 51 and 52 draws the conduit rearwardly from the reels 180 and from the machines as the frames 65 move along the corresponding routes. The machines are then lowered by extending the ram assemblies 58 so that all four of the wheels 70 and 75 engage the earth surface. The ram assemblies, typically, are further extended to transfer sufficient weight from the tractor 50 to maintain the furrowing elements 90 beneath the earth surface as the apparatus 30 is moved along the routes to install the conduit. As the apparatus is so moved with the conduit 35 being unwound and drawn from the reels, each machine operates in a manner now to be described.

Figure 18:
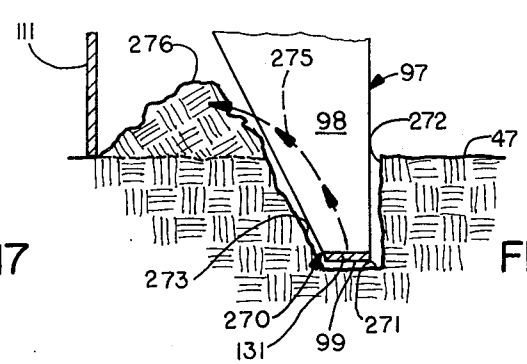
FIGS. 16 through 23 are vertical sections taken, respectively, from the positions of the corresponding lines 16—16 through 23—23 of FIG. 1 at the other of the machines and at an enlarged scale, the sections depicting successive operations of a machine as it installs drip irrigation conduit in the earth surface.
Figure 17:
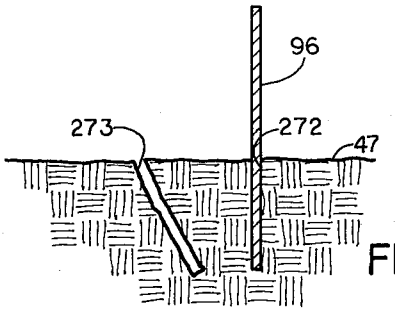
Figure 16:
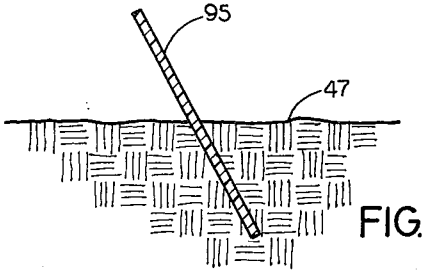

First, and as shown in FIGS. 16 through 18, the furrowing elements 90 of each machine 31 or 32 engage the earth surface 47, and generate therein a furrow 270 extending in the predetermined direction of movement along the corresponding route 51 or 52. The furrow so generated is substantially shallower than that created by a conventional ripper blade used in installing drip irrigation conduit, so that substantially less damage occurs to the roots of trees 42, or the like, along the corresponding route, this route preferably being relatively close to the trees for advantageous supply of water thereto. Further, the coulters 95 and 96 sever such roots rather than dragging them from the earth surface as occurs with a ripper blade.

Figure 20:
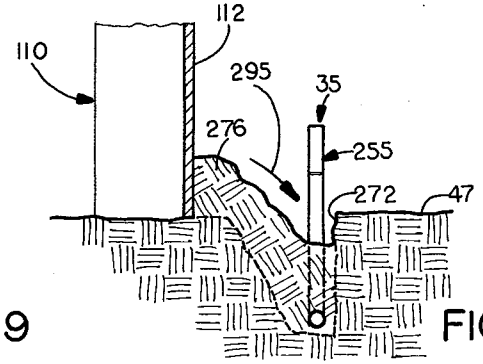

The furrow 270 has a bottom 271 disposed, as best shown in FIG. 20, below the earth surface 47 a distance somewhat greater than the difference between the predetermined length 262 of the risers 255 and the predetermined height 263 that the emitters 258 extend above the earth surface. The furrow has a pair of opposite and generally planar walls 272 and 273 extended upwardly from the bottom. One of the walls, the wall 273, is substantially vertical and is generated by the vertical coulter 96, as shown in FIG. 17. The other of the walls, the wall 273, is generated by the inclined coulter 95, as shown in FIG. 16 and is, therefore, disposed at an acute angle to the one wall. Subsequent to generation of these walls, the earth therebetween is engaged by the plow 97. As shown in FIG. 18, the leading edge 99 of the plow cuts the bottom of the furrow while the moldboard 98 engages the earth disposed between the walls and deposits this earth, as indicated by the arrows 275, on the earth surface in a heap 276, shown in FIGS. 18 and 19 thereby generating the furrow. This heap is disposed between the inclined wall and the plate 111 of the crowder 110. The earth so deposited is confined by this plate to a location on the earth surface adjacent to the inclined wall and opposite the furrow from the vertical wall. The distance between this plate and the furrow is adjusted by the brackets 115, as above described, so that the heap will be so disposed when the apparatus moves at a desired predetermined speed along the routes 51 and 52.

Figure 19:
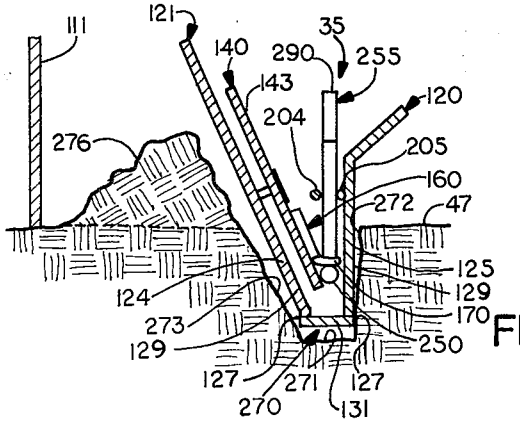

Certain other relationships follow from the previously described relationships of the coulters 95 and 96 which generate, respectively, the inclined wall 273 and the vertical wall 272, to the guards 120 and 121 and to the wheel 140. One such other relationship is that the orbital path 156 of the wheel and its rotational plane are, as best shown in FIGS. 6 and 19, generally parallel to the inclined wall as is the plate 125. Another such relationship is that the one side 143 of the wheel is disposed toward the vertical wall while its opposite side 144 is disposed toward the inclined wall. Further, it can be seen that the wheel is mounted on the frame 65 so that the plane of the orbital path is disposed in adjacent spaced relation to the inclined wall oppositely thereof of the plate 124 and that this plane extends upwardly along the inclined wall. It is apparent that the plate 125 is disposed adjacent to the vertical wall and between this wall and the wheel. It is also apparent that the respective lower edges 127 of the plates 124 and 125 extend downwardly of the periphery 150 of the wheel while the plates extend upwardly from the furrow bottom 271 with the bottom plate 131 extending along the furrow bottom beneath the wheel 140. As a result, although the sector 152 is adjacent to the furrow bottom, the wheel does not engage this bottom. By reference to FIG. 19, it is evident that each guard, which extends upwardly from the furrow bottom along the corresponding wall, is disposed to engage this wall and serves to retain it from collapsing in the vicinity of the wheel. Because of the plates 124, 125, and 131, the furrow walls or bottom cannot engage the wheel, the finger assemblies 160, or the portion of the conduit 35 disposed at the wheel to damage the conduit or these elements and/or interfere with their movement.

Referring now to FIGS. 1 and 9, it can be seen that, as conduit 35 leaves each reel 180 and moves toward the entrance 188 of the corresponding conduit guide 185, the risers 255 are disposed in an angular position about the hose 250 corresponding generally to the movement indicated by the numeral 261 in FIG. 13 because the risers can pivot about the hose. An operator at the corresponding seat 240 can bring such angular position of the risers within a range thereof sufficient to be received by the entrance. However, it is not possible, when conduit is being installed by the machines 31 and 32 at the usual rate, manually precisely to position each riser angularly about the hose in a position for subsequent engagement by the wheel 140 and associated elements and installation in the earth surface 47 in the desired upright position. Therefore, the conduit approaches the entrance with the risers in an indeterminate position in such range of angular positions. It is evident that the hose moves through the entrance in a course generally parallel to the general course 186 of the conduit through the conduit guide 185. As the hose moves in its course, each riser may engage, successively, as shown in FIGS. 10 through 11, the first projection 230, which is a portion of the first rail 204 and the second projection 231, which is a portion of the second rail 205. Or, if the riser is suitably disposed angularly about the hose, the riser may bypass the first projection and engage the second projection. In either event, such engagement results in the riser following in a course, which is indicated by the arrows 280 and is generally along the course 186, in which the riser pivots about the hose into a position between the distal end 236 of the second projection and the first rail 204. The riser is then subsequently pivoted into a position, indicated by the numeral 282 in FIG. 13, by engagement between the distal end of the third projection and the second rail 205. This position corresponds to a predetermined angular position of the riser about the hose and between the rails, which converge as shown in FIG. 13 and previously described, and guide the riser as it moves toward the wheel 140 so that the riser arrives thereat with its distal portion 257 in a predetermined position 285, which is depicted in dash lines in FIGS. 5 and 6 and is subsequently described in greater detail. In this latter position, the riser is disposed for engagement by the surface 222 of the first portion 220 of the first rail 204. It is apparent from the foregoing description tht the riser is received between the rails when the riser is in any position in such range of angular positions and is pivoted into the position 282 by engagement with one or both of the projections 230 and 231 of the rails. As the risers are guided toward the wheel by the rails, 205, it is evident that the hose 250 is received from the reel 180 by the hose guide 218 and is guided thereby along the general conduit course 186 to the wheel at the point 202. It is also evident that the second rail 205 receives the risers successively from the reel and guides their distal portions 257 to the position 285 for subsequent movement along the first rail 204 to its first portion 220.

Referring now to FIGS. 5 and 7, it is seen that, when a portion of the hose 250 of the conduits 35 arrives at the point 202 on the orbital path 156, this portion becomes engaged between an adjacent finger 170, which is normally in its first position 176, and the one side 143 of the wheel 140 with the hose disposed radially outwardly of the wheel from the finger. As the apparatus 30 continues to move along the routes 51 and 52, the hose is drawn from the reel 180 and is maintained at the lower portion 157 of the orbital path 156 by engagement with the fingers which are disposed so as to engage the hose upwardly of the path. Engagement of the fingers and the one side by the hose as it is drawn from the reel frictionally drives the wheel so that it rotates along the path. As a result, the fingers urge the hose toward the bottom 271 of the furrow 270 as the fingers move toward the lower portion of the path so that the hose subsequently moves with the lower sector 152 of the wheel and is brought into parallel adjacent relation with the bottom of the furrow, as may be visualized from FIGS. 5 and 9. Continued rotation of the wheel moves the fingers upwardly from the hose and, since the hose is anchored as described above and the apparatus continues to move, leaves the hose extended along the furrow bottom.

As best seen in FIGS. 5 and 7, when a location on the hose 250 arrives at the point 202 a riser 255, having its associated fitting 252 at that point, is disposed in the position 285 and, because of the relative disposition of the trough 200 and wheel 140, is extended generally radially of the wheel and the orbital path 156. At such position the riser is also disposed between the first rail 204 and the second rail 205. However, continued rotation of the wheel moves the riser beyond the end 211 of the second rail. As a result and as such fitting moves with the wheel and along its lower sector 152, the corresponding riser becomes disposed between the one surface 222 of the horizontal portion 220 of the first rail and the second plate 125 and between this surface and the vertical wall 272 of the furrow 270. When so disposed the riser is, of course, also disposed oppositely of the first rail from the wheel, as best shown in FIG. 6. As each riser moves with its respective fitting from the position 285 of the riser, the proximal portion 256 of the riser is carried downwardly in relation to its distal portion 257 bringing the riser to an upright position or erect disposition indicated by the numeral 290 in FIGS. 5, 6 and 19. The riser is then adjacent to the vertical furrow wall 272 although the riser is disposed oppositely of the second plate 125 from this wall. As each riser is brought to its erect disposition from its position 285, engagement of the first rail with the riser urges the distal portion of the riser away from the one side 143 of the wheel so that the distal portion does not engage the fingers 170 as the wheel rotates. The riser is thus guided by the one surface 222 between the horizontal portion 220 of the first rail 204 and the vertical guard 120. As the apparatus continues to move along the routes 51 and 52, the riser is maintained in its erect disposition by opposite engagement between the second plate and such surface 222 of the first rail as the proximal riser portion moves along the portion 157 of the orbital path. As the apparatus moves further, the guards 120 and 121 move therewith from the riser, which has been erected as just described, delivering the riser into the furrow so that the riser is in an erect disposition and projects upwardly from the furrow, as shown in FIG. 22, with the riser engaged with the vertical furrow wall. This wall thus maintains the riser in such disposition immediately after its delivery into the furrow.

The foregoing assumes that, as the fingers 170 engaged the hose 250 in the vicinity of the point 202, the fingers did not engage a riser 255. If the fingers were rigidly mounted on the wheel 140, such engagement with the proximal portion 256 of a riser would break off or otherwise damage the riser. However, the fingers are pivotally mounted on the wheel as above described and best shown in FIGS. 7 and 8. Therefore, engagement of a finger with a riser as the finger moves toward engagement with the hose urges the finger to pivot from its first position 176 toward the one side 143 of the wheel and into the second position 177 so that the riser is not damaged by the finger. As the riser subsequently moves away from the wheel, the finger is returned to its first position by the spring 174.

Figure 21:
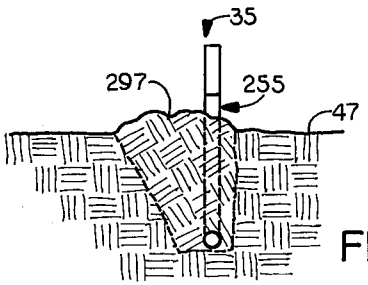

As best seen from FIGS. 1, 2 and 20, the surface 112 of each crowder 110 is disposed so that, as the apparatus 30 moves along the corresponding route 51 or 52 with conduit 35 being delivered into the adjacent furrow 270 and with the risers 255 maintained in an erect disposition due to engagement with the vertical wall 272 of the furrow, the crowder surface urges earth deposited into the heap 276 into the furrow rearwardly of the guards 120 and 121 and rearwardly of the lower portion 157 of the orbital path 156. Such earth is, therefore, returned to the furrow in a direction toward the vertical wall as indicated by the arrow 295 in FIG. 20. As a result, the earth being so returned urges the risers successively against the vertical wall and into engagement therwith so that the wall maintains each riser in an erect disposition while the furrow is backfilled in the vicinity of the riser. As the apparatus continues to move, the crowder completes backfilling the furrow, as shown in FIG. 21, so that the hose is buried in the furrow and the risers are retained in their desired erect position by the returned earth 297 which is not packed at this point and, typically, has a humped configuration.

Figure 23:
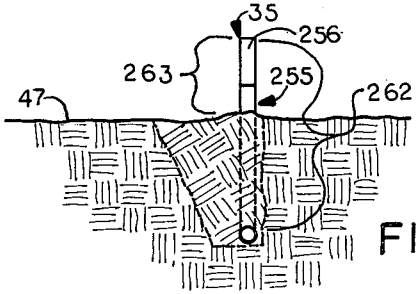

Subseqeuntly, since the groove 77 of each rearward roller 75 is aligned along the corresponding route 51 or 52, the cylindrical end portions 78 of this roller engage the humped, returned earth oppositely of the installed conduit 35 and its emitters 258 which extend upwardly from the earth surface 47. The roller thus compacts the earth surface, as shown in FIG. 22, while the emitters pass successively through the groove. As a result, when the apparatus 30 has completed installation of conduit in the vicinity of a riser 255, the riser, the hose 250, and the adjacent earth appear as depicted in FIG. 23. It is evident that the buried hose 250 anchors the conduit in the earth surface 47 rearwardly of each machine 31 or 32 with the hose extended from the corresponding reel 180 along the course 186 and about the wheel 140 into the furrow 270. Therefore, the conduit is drawn rearwardly from the machine as its frame 65 moves along the corresponding route and away from previously buried hose of conduit installed by the machine.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A machine for installing irrigation conduit in the earth surface, the conduit including a flexible hose and a plurality of risers of a predetermined length spaced along the hose and extended transversely from the hose at one side thereof and the machine comprising a frame adapted for movement along the earth surface; means mounted on the frame for forming a furrow extending along the earth surface having a substantially vertical side wall, and an opposite side wall, said furrow forming means depositing earth taken from the furrow along the side of the furrow opposite to the vertical side wall; means for feeding the conduit into the furrow; hose engaging means mounted on the frame and having a portion disposed rearwardly of the furrowing means at a position which is adjacent to the bottom of a furrow formed thereby for engaging the hose in a disposition in which the hose extends along the bottom of such furrow with the risers in an erect disposition and engaged against the vertical wall of the furrow and back-filling means engagable with earth taken from the furrow for returning such earth to the furrow rearwardly of said portion of the path toward the vertical wall to cover the hose in the furrow and to retain the risers in said erect disposition against the vertical wall.

2. A machine for installing irrigation conduit in the earth surface, the conduit including a flexible hose and a plurality of risers of a predetermind length spaced along the hose and extended transversely from the hose at one side thereof and the machine comprising a frame adapted for movement in a predetermined direction along the earth surface; supply means mounted on the frame for transporting conduit to be installed; furrowing means mounted on the frame for removing earth at said surface to generate a furrow extending in the predetermined direction and having a depth less than said predetermined length; hose engaging means mounted on the frame and having a portion disposed rearwardly of the furrowing means at a position which is adjacent to the bottom of a furrow formed thereby for engaging the hose in a disposition in which the hose extends along the bottom of such furrow with the risers in an erect disposition and projecting upwardly from such furrow; the hose engaging means being mounted on the frame for movement in an orbital path about a generally horizontal axis, and said portion of said means moves along a lower portion of the path in a direction opposite to said predetermined direction; wherein the conduit guiding means delivers the hose to said engaging means at a point upwardly and in said direction from said lower portion with the risers extended generally radially of the path, the hose being engaged by the engaging means and carried thereby to said lower portion so that the risers are brought into said erect disposition.

3. A machine for installing irrigation conduit in the earth surface, the conduit including a flexible hose and a plurality of risers of predetermined length spaced along the hose and extended transversely from the hose at one side thereof and the machine comprising a frame adapted for movement in a predetermined direction along the earth surface; supply means mounted on the frame for transportation conduit to be installed, furrowing means mounted on the frame for removing earth at said surface to generate a furrow extending in the predetermined direction and having a depth less than said predetermined length; the furrowing means comprising:

A. a vertical, planar, and peripherally circular blade mounted on the frame for rotation about an axis extended horizontally and transversely of said predetermined direction so as to generate one furrow wall which is substantially vertical, B. an inclined, planar, and peripherally circular blade mounted on the frame for rotation about an axis extended transversely of said predetermined direction and at an acute angle to the horizontal so as to generate another furrow wall which is opposite said one wall and is disposed at an acture angle to said one wall, and C. a moldboard mounted on the frame rearwardly of said blades and disposed to deposit earth, which was disposed between said walls, on the earth surface adjacent to said other wall and oppositely of the furrow from said one wall; hose engaging means mounted on the frame and having a portion disposed rearwardly of the furrowing means at a position which is adjacent to the bottom of a furrow formed thereby for engaging the hose in a disposition in which the hose extends along the bottom of such furrow with the risers in an erect disposition and projecting upwardly from such furrow; means for guiding the conduit from the supply means to the engaging means; and backfilling means for returning earth so removed to the furrow rearwardly of said portion of the path to cover the hose in the furrow and to retain the risers in said erect disposition.

4. A machine for installing drip irrigation conduit in the earth surface, the conduit including a flexible hose and a plurality of risers of a predetermined length spaced along the hose and extended transversely from the hose at one side thereof, the machine comprising:

A. a frame adapted for movement in a predetermined direction along the earth surface;

B. supply means mounted on the frame for transporting conduit to be installed;

C. furrowing means mounted on the frame for removing earth at said surface to generate a furrow extending in the predetermined direction and having a depth less than said predetermined length;

D. hose engaging means mounted on the frame for movement in an orbital path about a generally horizontal axis, the path having a lower portion disposed rearwardly of the furrowing means at a position which is adjacent to the bottom of a furrow formed thereby, said means being movable at said lower portion in a direction generally along the furrow and opposite to the predetermined direction;

E. means for guiding the conduit from the supply means to the engaging means so that the hose intersects the path in a disposition for engagement by the engaging means and with each riser in a position extending generally radially of the path, so that the hose is engaged by said means and carried thereby to said portion of the path so as to extend the hose along the bottom of such furrow with the risers in an erect disposition and projecting upwardly from such furrow; and F. backfilling means for returning earth so removed to the furrow rearwardly of said portion of the path to cover the hose in the furrow and to retain the risers in said erect disposition.

5. The machine of claim 4 wherein the hose engaging means comprises a wheel mounted on the frame for rotation about a generally horizontal axis extending transversely of said predetermined direction so that a lower sector of the periphery of a side of the wheel moves along said lower portion of the path.

6. The machine of claim 5 wherein the wheel has a plurality of fingers mounted on the side thereof and spaced along the path circumferentially of the wheel, each finger being extended from the side and disposed to engage the hose upwardly at said portion of the path and urge the hose toward the bottom of the furrow as the finger moves along said portion.

7. The machine of claim 6 wherein each riser has a proximal portion adjacent to the hose and a distal portion and wherein the means for guiding the conduit comprises:

A. a first riser guide which extends generally parallel to said side of the wheel and in said predetermined direction, said guide being disposed upwardly of said sector and spaced from said one side in a direction axially away from the wheel;

B. a hose guide extended between the supply means and the orbital path and disposed to receive the hose from the supply means and deliver the hose to the wheel for said engagement by the fingers, and C. a second riser guide extended along the hose guide between the supply means and the first guide to receive the risers successively from the supply means and guide the distal portion of each riser to the first guide with the riser extended generally radially of the wheel and disposed oppositely of the first guide therefrom, so that movement of the wheel along said path carries the proximal portion of the riser downwardly and brings the riser to such erect disposition with the first guide engaging the riser and urging the distal portion away from said side of the wheel so that the distal portion is not engaged by the fingers as the wheel rotates.

8. The machine of claim 7 wherein

A. each finger is mounted on the wheel for movement toward and from said side of the wheel so that engagement of the finger with a proximal portion of a riser as the finger moves into engagement with the hose moves the finger toward the side so that the riser is not damaged by the finger, and B. each finger has resilient means urging the finger from the side for engagement with the hose when a riser is disengaged from the finger.

9. The machine of claim 7 wherein the risers are of a predetermined thickness, wherein the means for guiding the conduit guides the hose in a predetermined course between the supply means and the intersection of the hose with the orbital path, wherein the angular position of each riser about the hose as the riser approaches said guiding means from the supply means is indeterminate, and wherein said guiding means includes a pair of elements extending generally along said course and spaced therefrom, said elements being disposed in spaced apart relation and converging in a direction from the supply means toward said intersection to a distance apart somewhat greater than the thickness of the risers, so that each riser is engaged by one of said elements as the riser moves toward said intersection and is urged by said one element to a predetermined angular position about the hose corresponding to the position of the riser when the hose is in said disposition for engagement by said engaging means.

10. The machine of claim 9 wherein the supply means is a reel rotationally mounted on the frame, and the means for guiding the conduit has an entrance for the conduit, the entrance being directed generally toward and tangentially of the reel.

11. The machine of claim 4 in which:

A. the furrowing means is adapted to generate the furrow with opposite and generally planar walls in the earth surface, one wall being substantially vertical and the other wall being disposed at an acute angle to said one wall, and to deposit the earth so removed on the earth surface oppositely of the furrow from said one wall;

B. the path of the hose engaging means is generally planar and parallel to said other wall, said means being disposed on the frame so that the plane of said path is disposed in adjacent spaced relation to said other wall and extends upwardly therealong from said lower portion of the path;

C. the means for guiding the conduit comprising:

(1) a first riser guide, which extends generally horizontally and parallel to said predetermined direction, which is disposed above said lower portion, and which is spaced horizontally from said path toward the position of said one wall, said guide having one side disposed toward said one wall; and (2) a second riser guide disposed to receive the risers successively from the supply means and deliver each riser to the first riser guide at said one side thereof so that, as the hose is carried along said lower portion of the path by the hose engaging means, the riser is disposed between said one wall and said one side and is maintained in a generally erect disposition by engagement with said one side; and D. the backfilling means is adapted to return the earth so deposited into the furrow in a direction toward said one wall urging the riser against said one wall to maintain the riser in an erect disposition as said earth is returned to the furrow.

12. The machine of claim 11 wherein the hose engaging means comprises a generally planar wheel mounted on the frame for rotation in a plane substantially parallel to said other wall, the wheel being disposed so that the lowest sector of the periphery of one side of the wheel moves along said portion of the orbital path and the opposite side of the wheel is disposed toward said other wall.

13. The machine of claim 12 wherein the machine further comprises

A. a first plate mounted on the frame parallel to the wheel, said plate being disposed between the wheel and the position of said other wall and extended somewhat downwardly of the periphery of the wheel so that the wheel does not engage said other wall of the furrow or the bottom thereof; and B. a second plate mounted on the frame and extended parallel to said predetermined direction in a generally upright disposition oppositely of the first riser guide from the wheel, the second plate (1) being disposed in a position adjacent to said one wall between said one wall and the wheel, (2) being extended somewhat downwardly of the periphery of the wheel so that the wheel does not engage said one wall of the furrow, and (3) being spaced from said one side of the first riser guide a distance somewhat greater than the thickness of a riser, so that each riser is maintained in an erect disposition by being oppositely engaged by the second plate and said guide as the hose moves along said portion of the orbital path and is delivered into the furrow in said erect disposition in a position adjacent to said one wall to be urged thereagainst by earth returned to the furrow in a direction toward said one wall by the backfilling means.

14. The machine of claim 4 wherein:

A. the furrowing means comprises (1) a vertical coulter mounted on the frame for rotation about an axis extended horizontally and transversely of said predetermined direction so as to generate one furrow wall which is substantially vertical, (2) an inclined coulter mounted on the frame for rotation about an axis extended transversely of said predetermined direction and at an acute angle to the horizontal so as to generate another furrow wall which is opposite said one wall and is disposed at an acute angle to said one wall, and (3) a moldboard mounted on the frame rearwardly of said coulters and disposed to deposit earth, which was disposed between said walls, on the earth surface adjacent to said other wall and oppositely of the furrow from said one wall; and B. the backfilling means comprises a crowder having a surface disposed in a direction opposite said predetermined direction from said portion of the orbital path to engage the earth so deposited by the moldboard and to return said earth into the furrow in a direction toward the one wall to urge the risers successively into engagement therewith so that each riser is maintained by the one wall in an erect disposition as the earth is returned to the furrow in the vicinity of the riser.

15. A machine for installing drip irrigation conduit, the conduit being preprepared having a continuous flexible hose which has a first predetermined thickness and which, when the conduit is installed, extends horizontally and is buried at a predetermined depth in the earth surface along a predetermined route; and having a plurality of upright risers of a second predetermined thickness spaced along the hose with each riser extending substantially normal to a corresponding portion of the hose adjacent to the riser and, when the conduit is installed, extending from the hose to above the earth surface, the machine comprising:

A. a frame;

B. means for supporting the frame at a predetermined distance above the earth surface for earth traversing movement in a predetermined direction along the route;

C. furrowing means mounted on the frame for removing earth at the earth surface to generate a furrow which has a bottom disposed at the predetermined depth and a pair of opposite walls, one wall extending substantially vertically and the other wall extending at an acute angle to the one wall, and for depositing the earth so removed on the earth surface along the furrow oppositely of the furrow from the one wall;

D. supply means mounted on the frame for transporting a length of said conduit therewith, the hose extending from said means into the furrow and being drawn rearwardly from the machine as the frame moves along the route from hose previously buried in the furrow;

E. a pair of downwardly convergent, generally planar guards extending along said predetermined direction and having individual lower edges, the guards being mounted on the frame for movement therewith in a disposition such that said edges are spaced transversely of said predetermined direction and are adjacent to the bottom of the furrow and the guards being extended upwardly from the bottom with one of the guards extending along said one wall and the other guard extending along said other wall;

F. a wheel mounted on said other guard for rotation in a plane parallel thereto, the wheel having (1) one side disposed toward said one guard and a periphery having a lower sector disposed in upwardly adjacent relation to said lower edges and spaced transversely of said predetermined direction from the lower edge of the one guard a distance greater than said first predetermined thickness, and (2) a plurality of fingers mounted on said one side for rotation with the wheel, the fingers being spaced circumferentially about said one side, being spaced radially inwardly of the periphery a distance generally equal to the first predetermined thickness, and being extended axially of the wheel from said one side;

G. hose guide means mounted on the frame for movement therewith and extended between the supply means and a point disposed upwardly of and in said predetermined direction from said sector for guiding the hose from the supply means to said point for engagement thereat by the fingers and the one side with the hose disposed radially outwardly of the wheel from the fingers so that, as the conduit is drawn from the supply means, said engagement urges the wheel to rotate and the hose moves with said sector and is brought into adjacent, parallel relation with the bottom of the furrow;

H. riser guide means mounted on the frame for movement therewith having (1) a rail which has a first portion extending upwardly of the lower edges of the guards and generally horizontally between said one side of the wheel and said one guard and has a second portion extending from the first portion along the hose guide means toward the supply means, said first portion having one surface disposed toward and spaced from the one guard a distance greater than said second predetermined thickness and having an opposite surface spaced from said one side of the wheel for passage of the fingers therebetween, and (2) a member extending along said second portion of the rail between the supply means and said first portion of the rail for guiding the risers successively into engagement with said one surface of said first portion as the hose is drawn from the supply means, so that said one surface guides each riser to pass between the said first portion and said one guard, and so that, as said corresponding portion of the hose travels with said sector into such parallel relation with the bottom of the furrow, the riser is brought into an upright position adjacent to said one wall of the furrow, subsequently to engage said wall in the upright position for maintenance therein by said wall as the guards move in said predetermined direction from the riser; and I. a crowder mounted on the frame for movement therewith having a surface extended from said other wall of the furrow in angular relation to said predetermined direction and disposed to engage the earth removed from the furrow and to return such earth thereto in a direction toward said one wall of the furrow so that the risers are successively engaged by the earth being so returned and are urged thereby against the one wall and maintained thereagainst in the upright position by the earth returned to the furrow.

16. The machine of claim 15 further comprising a planar member extended generally horizontally between the lower edges of the guards in interconnecting relation thereto.

17. The machine of claim 15 wherein the furrowing means comprises

A. a first coulter disposed forwardly of the guards and mounted on the frame for movement therewith and for rotation about an axis extended transversely of said predetermined direction and at an acute angle to the horizontal to generate said other wall of the furrow, B. a second coulter disposed forwardly of the guards and mounted on the frame for movement therewith and for rotation about a substantially horizontal axis to generate said one wall of the furrow, and C. a moldboard mounted on the frame for movement therewith and disposed rearwardly of the coulters and forwardly of the guards, the moldboard being disposed to engage earth between the walls and generate the furrow by depositing such earth alongside said other wall.

18. The machine of claim 15 wherein the supply means comprises a reel mounted on the frame for rotation about a predetermined axis to receive the preprepared conduit in wound about relation to the reel with each riser extended generally parallel to said axis and maintained in such relation by hose of the conduit wound about the reel outwardly of and about the riser.

19. The machine of claim 18 wherein the risers are mounted on the hose for pivotal movement in a plane normal thereto and wherein said first portion of the rail has a projection extending toward said member of the riser guide and away from the reel in converging relation to said member, and said member of the riser guide has a projection extending toward said second portion and away from the reel in converging relation to said second portion, so that each riser is engaged by one of said projections as the riser moves from the supply means and is pivoted about the hose into a predetermined angular position about the hose corresponding to such a predetermined angular position into which the riser is guided by said member for engagement of the riser with said one surface of the first portion of the rail.

20. The machine of claim 18 wherein the machine is for use adjacent to a row of existing plants having trunks disposed along the route at one side thereof and having branches extended thereacross; wherein the reel is disposed transversely of the route and oppositely of the trunks therefrom to avoid engagement with the branches; and wherein the hose guide means and the riser guide means extend toward and tangentially of the reel to receive the conduit therefrom.

21. The machine of claim 15 wherein the hose guide and said member of the riser guide means extend toward the supply means; wherein the risers are mounted on the hose for pivotal movement in a plane normal thereto, and as the conduit leaves the supply means, are disposed in indeterminate positions within a range of angles about the hose; and wherein the second portion of the rail and the said member of the riser guide means diverge in a direction toward the reel and converge in the opposite direction to a distance apart somewhat greater than the second predetermined thickness so that each riser is received between said member and said second portion when the riser is disposed in any position within said range, the riser being pivoted by engagement with said second portion and said member into a predetermined angular position about the hose as said second portion and said member converge and the riser being subsequently guided therebetween so as to be disposed in a predetermined angular position about the hose when the riser engages said one surface of said first portion of the rail.

22. The machine of claim 15 wherein each riser of conduit installed by the machine extends a predetermined height above the earth surface and wherein the means for supporting the frame includes a roller disposed rearwardly of said surface of the crowder and mounted on the frame for movement therewith and for rotation about an axis extended substantially horizontally and transversely of said predetermined direction and disposed from said surface of the crowder in a direction opposite said predetermined direction, the roller having an annular groove, which has a radial depth greater than said predetermined height, and a pair of cylindrical end portions disposed axially oppositely of the groove to compact the earth surface oppositely of the installed conduit while the risers pass successively through the groove.

23. The machine of claim 15 wherein the machine is for use adjacent to existing plants which are disposed along the route and which have lower branches extended thereacross and wherein the machine further comprises an elongated bar mounted on and upwardly of the frame, the bar having a central, generally horizontal portion extending along the frame in said predetermined direction and having a forward portion extended downwardly and in said direction from the central portion so that, as the frame moves in said predetermined direction, said branches are engaged by the forward portion and are urged upwardly to the central portion and held thereby from engagement from the balance of the machine.

* * * * *

UNITED STATES PATENT AND TRADEMARK OFFICE

CERTIFICATE OF CORRECTION

PATENT NO. : 4,461,598

DATED : July 24, 1984

INVENTOR(S) : Ronald D. Flechs

It is certified that error appears in the above-identified patent and that said Letters Patent is hereby corrected as shown below:

Column 1, Line 9, after "installing", delete "pipe pre-" and substitute ---prepre---.

Column 2, Line 29, delete "to" and substitute ---so---.

Column 4, Line 23, delete "would" and substitute ---wound---.

Column 5, Line 34, delete "defined" and substitute ---define---.

Column 9, Line 65, delete "surface" and substitute ---course---.

UNITED STATES PATENT AND TRADEMARK OFFICE

CERTIFICATE OF CORRECTION

PATENT NO. : 4,461,598

DATED : July 24, 1984

INVENTOR(S) : Ronald D. Flechs

It is certified that error appears in the above-identified patent and that said Letters Patent is hereby corrected as shown below:

Column 10, Line 1, delete "evnisioned" and substitute ---envisioned---.

Column 12, Line 39, delete "Fig. 33" and substitute ---Fig. 23---.

Column 18, Line 24, between "of" and "predetermined" insert ---a---.

Column 18, Line 44, delete "acture" and substitute ---acute---.

Signed and Sealed this

*Twenty-sixth* Day of *March 1985*

[SEAL]

*Attest:*

DONALD J. QUIGG

*Attesting Officer*

*Acting Commissioner of Patents and Trademarks*